US005181401A

United States Patent [19]

Hodan

[11] Patent Number: 5,181,401

[45] Date of Patent: Jan. 26, 1993

[54] YARN COATING APPLICATOR

[75] Inventor: John A. Hodan, Arden, N.C.

[73] Assignee: BASF Corporation, Parsippany, N.J.

[21] Appl. No.: 638,674

[22] Filed: Jan. 8, 1991

[51] Int. Cl.[5] ..... D06B 1/08

[52] U.S. Cl. ..... 68/200; 118/420

[58] Field of Search ..... 68/200, 6; 28/178, 182; 118/266, 401, 411, 420, 423; 427/434.6, 434.7

[56] References Cited

U.S. PATENT DOCUMENTS

| | | | |
|---|---|---|---|
| 2,228,260 | 1/1941 | Dreyfus et al. | 28/178 X |
| 2,294,870 | 9/1942 | Kline et al. . | |
| 2,377,655 | 6/1945 | Stanley et al. . | |
| 2,868,159 | 1/1959 | Lit et al. | 118/420 X |
| 3,004,865 | 10/1961 | Schmitz . | |
| 3,162,544 | 12/1964 | Gobert | 68/200 X |
| 3,336,633 | 8/1967 | Curran, Jr. . | |
| 3,540,240 | 11/1970 | Higashino . | |
| 3,893,412 | 7/1975 | Louch et al. . | |
| 3,978,695 | 9/1976 | Hurzler . | |
| 4,051,807 | 10/1977 | Graf et al. . | |
| 4,338,876 | 7/1982 | Norton . | |
| 4,545,835 | 10/1985 | Gusack et al. . | |
| 4,666,542 | 5/1987 | De Jongkheere | 118/420 X |
| 4,686,123 | 8/1987 | Levan . | |
| 4,704,311 | 1/1987 | Pickering et al. . | |
| 4,714,045 | 12/1987 | Reinher et al. . | |
| 4,949,441 | 8/1990 | Ethridge . | |

FOREIGN PATENT DOCUMENTS

| | | | |
|---|---|---|---|
| 937729 | 9/1963 | United Kingdom | 68/6 |

*Primary Examiner*—Philip R. Coe

[57] ABSTRACT

A yarn coating applicator includes a pair of yarn guide blocks and an intermediate delivery plate. The guide blocks include an opening which may be in the form of a slot at the edge of the guide block. The plate includes a supply means, such as an inlet, for providing the coating fluid to the plate and channels by which the treatment fluid is conveyed to fluid reservoirs in the applicator. The openings in the guide blocks communicate with the reservoir hole in the plate to provide a yarn passageway through the applicator.

12 Claims, 2 Drawing Sheets

YARN COATING APPLICATOR

BACKGROUND OF THE INVENTION

This invention relates to an apparatus for applying a treatment fluid to a yarn, filament or bundle of filaments.

Various types of applicators which employ nozzles or jets to apply a treatment fluid, such as a coating, dye or chemical treatment, to a filament are known. (See, for example, U.S. Pat. No. 4,686,123 to Levan, U.S. Pat. No. 4,714,045 to Reinehr, et. al., U.S. Pat. No. 3,978,695 to Hurzeler, et. al., U.S. Pat. No. 3,004,865 to Schmitz and U.S. Pat. No. 2,377,655 to Stanley, et. al.

Other known applicators employ rollers (See U.S. Pat. No. 4,704,311 to Pickering, et. al.), spinning discs (See U.S. Pat. No. 4,338,876 to Norton) rotatable dishes (See U.S. Pat. No. 3,540,240 to Higashino) and reels (See U.S. Pat. No. 2,294,870 to Kline, et. al.) to deliver coatings or treatments to a filament.

These previously known applicators are complicated, containing many components and thus many opportunities for malfunction. Additionally, due to their complexity, they are fairly expensive to produce and repairs to these applicators normally require fairly lengthy downtime.

The applicator described in U.S. Pat. No. 3,893,472 to Louch, et. al. is one in which a traveling textile strand or yarn is aligned and guided into and through an open applicator channel which extends along the length of an elongated face of an elongated polyhedron. The applicator described in U.S. Pat. No. 4,051,807 to Graf, et. al. includes an applicator head having a guide edge against which a filament bundle is passed and at which the filament bundle is exposed to the treatment. Disadvantages of this applicator include the fact that there is no means for maintaining the filament bundle against the guide edge, and that both sides of the filament bundle cannot be simultaneously treated.

SUMMARY OF THE INVENTION

It is an object of the invention to provide an apparatus for the application of a treatment fluid, such as a coating, dye or chemical treatment, to a yarn, filament or bundle of filaments.

It is also an object of the invention to provide an applicator which is simple, inexpensive and easy to manufacture.

It is a further object of the invention to provide an applicator which can easily be repaired or replaced.

These objectives and other advantages are achieved by the invention by providing an applicator comprising a delivery plate and at least one, preferably a pair, of yarn guiding blocks.

The yarn guiding blocks include one or more openings to position the yarn for exposure to a treating fluid. The delivery plate includes supply means, such as an inlet, for providing the treatment fluid to the delivery plate and, if necessary, channels by which the treatment fluid is conveyed from the inlet to fluid reservoirs in the applicator. The fluid reservoir is a chamber, normally along or at the end of a channel, defined by a hole or opening formed in the delivery plate, bound on one or both sided by at least one yarn guide block. The openings in the yarn guide blocks communicate with the reservoir hole in the delivery plate to provide a yarn passageway through the applicator. Fluid provided to the devilry plate of the applicator fills the reservoir.

Yarn which has been threaded through the passageway is continuously pulled therethrough, and is pulled through the pool of fluid which has collected in the reservoir, thus exposing all sides of the yarn simultaneously to the treatment fluid.

In a preferred embodiment, the openings in the yarn guide blocks are formed as slots. Thus, the yarn guiding blocks include one or more yarn slots to position the yarn for exposure to a treating fluid. The delivery plate includes stilts corresponding in number and location to the yarn slots in the guide blocks, an inlet by which the treating fluid is supplied to the applicator and channels by which the treating fluid is distributed to fluid reservoirs in the applicator. Each slot in the first guide block is aligned with corresponding slots in the delivery plate and in the other guide block to provide a yarn passageway. Preferably, the yarn slots in the guide blocks are formed at an angle to the edge of the guide block, or, alternatively, the slots in the guide blocks, while sufficiently aligned to provide a yarn passageway, are slightly offset to provide a slanted passageway, helping to prevent the yarn from jumping out of the slot during treatment. Yarn placed in the yarn slots is exposed to the contents of the reservoir since the yarn slots of the guide blocks extend over the opening in the delivery plate which defines the reservoir.

The present invention will be described more fully hereinafter with reference to the accompanying drawings, in which an illustrative embodiment of the invention is shown. This invention can, however, be embodied in many different forms and the invention should not be construed as being limited to the specific embodiment set forth herein. Rather, applicant provides this embodiment so that this disclosure will be thorough and complete and will fully convey the scope of the invention to those skilled in the art.

DETAILED DESCRIPTION OF THE PREFERRED EMBODIMENTS

While the invention will be described with reference to the treatment of yarn, it should be understood that the applicator of the invention can be used to treat, in single strands or bundles of strands, any type of yarn, string, thread or filament. Similarly, while the invention will be described in terms of a coating, it should be understood that the applicator of the invention can be used to treat yarn with a wide variety of treatment fluids, such as, for example, coatings of various types, dyes, and chemical treatments in the form of gases or liquids.

Figure 1:
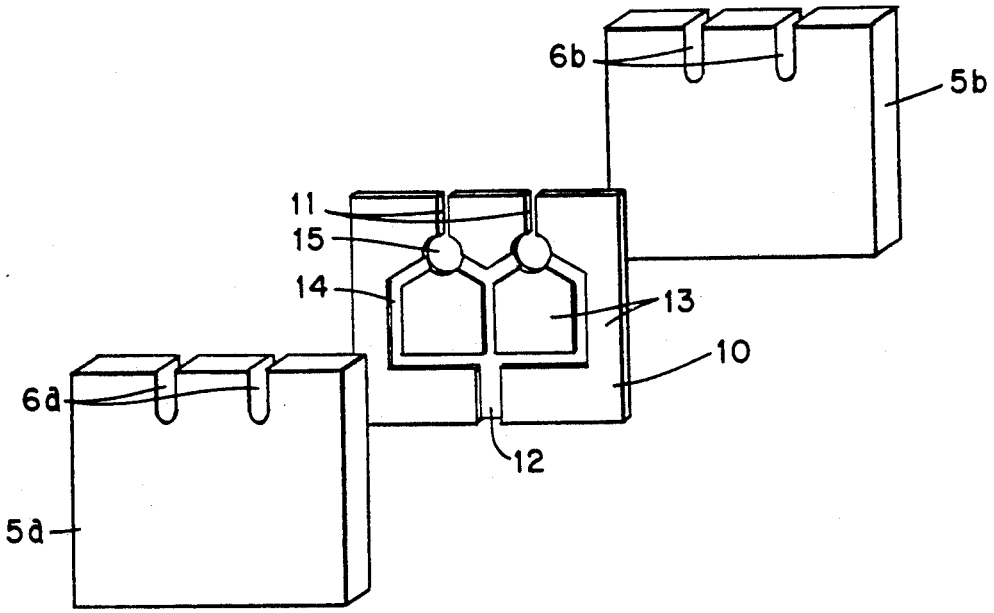
FIG. 1 is an exploded perspective view of the applicator of the invention.

Referring now to the drawings, FIG. 1 shows that the applicator of the invention includes a pair of yarn guiding blocks 5*a* and 5*b* on either side of a delivery plate 10. The yarn guiding blocks 5*a*, 5*b* include one or more openings which may be in the form of yarn slots 6a, 6b. The number of yarn slots 6a, 6b is determined by the number of strands of yarn to be treated. The slots 6a in yarn guiding block 5a may correspond in size, shape and location to the yarn slots 6b in guiding block 5b.

The yarn guide blocks 5a, 5b are made from materials which offer a minimum amount of friction against the yarn or filaments so as to reduce the possibility of filament fraying. Suitable materials include, but are not limited to polished chrome platings and ceramics, with ceramics being preferred.

The delivery plate 10 includes slots 11, inlet 12, delivery channels 14 and reservoir holes 15. The slots 11 in the delivery plate 10 correspond in number and location to the yarn slots 6a, 6b in the yarn guide blocks 5a, 5b. Reservoir holes 15 are located at the end of the slots 11 in the delivery plate 10. Inlet 12 constitutes supply means by which treatment fluid is provided to the delivery plate. Channels 14 lead from inlet 12 to reservoir holes 15. The exact pattern of the channels 14 is not critical, provided that the channels 14 convey a substantially equal, continuous supply of treatment fluid to each reservoir holes 15. Typically, therefore, the pattern formed by channels 14 will be symmetrical about the inlet 12 and the path lengths of channels 14 between inlet 12 and the reservoir holes 15 will be substantially equal. The channels 14 define raised areas or islands 13 which sealably contact yarn guiding block 5a when the applicator is assembled.

Delivery plate 10 can be manufactured from any suitable material, such as, for example, mild steel, stainless steel, brass, aluminum or plastic. The delivery plate 10 and the inlet 12, channels 14, reservoir 15 and slots 11 can be formed by any suitable manufacturing technique such as, for example, die cutting, drilling, stamping, punching, etching, machining or molding.

The overall dimensions of the yarn guide blocks 5a, 5b and the delivery plate 10 may vary considerably. In general, the yarn guide blocks 5a, 5b and the delivery plate 10 may have the same or substantially the same planar dimensions. The length of the components will vary with the number of yarns to be treated and the number of corresponding openings or yarn slots 6a, 6b which are necessary. As a rule of thumb, the components should have from about 0.25 to about 4.0 inches per opening or yarn slot.

The thickness of the yarn guide blocks 5a, 5b and the delivery plate 10 may vary considerably and may be the same or different. Preferably, however, the thickness of the two yarn guide blocks 5a, 5b are the same and may range from about 1/16 to about ½ inches. Compared to the yarn guide blocks 5a, 5b, the thickness of the delivery plate 10 is preferably relatively small, ranging from about 0.015 to about 0.10 inches. The depth of the channels 14 will vary according to the thickness of the delivery plate 10, but as a general rule the depth of thickness will represent from about 20% to about 100% of the thickness of the delivery plate 10.

The width of yarn slots 6a, 6b and slots 11 may be the same or different. The width of the openings or slots can vary depending upon the denier of the filament or yarn being treated, but preferably may range from about 0.04 to about 0.1 inches.

Figure 2:
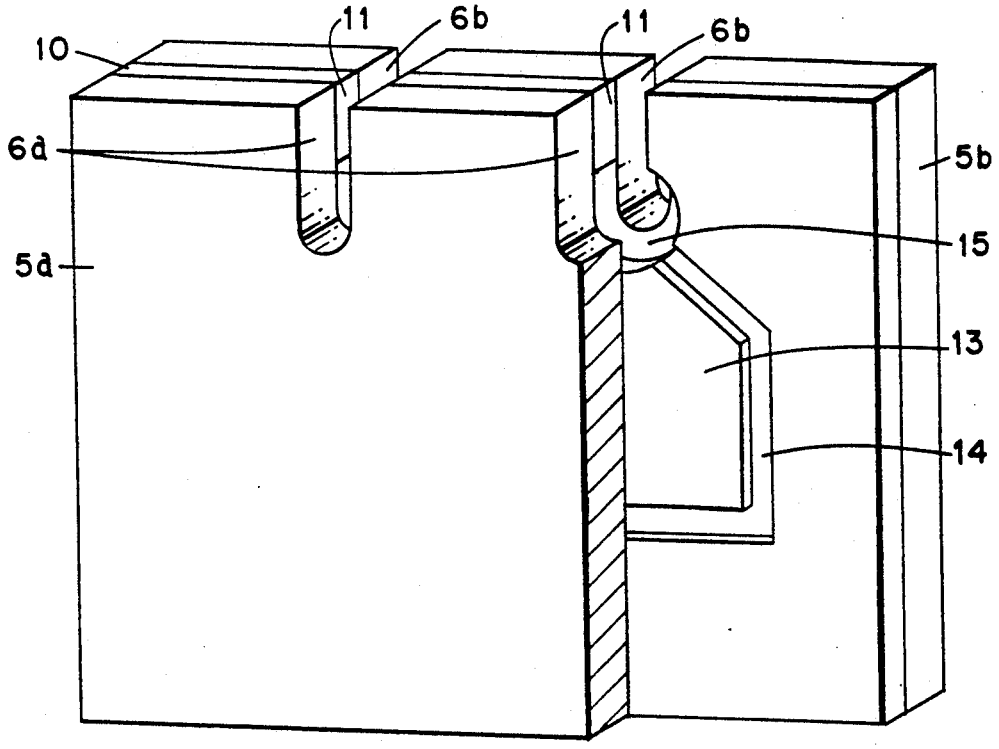
FIG. 2 is a partial perspective view of the applicator of the invention with a portion of one yarn guide block cut away.
Figure 3:
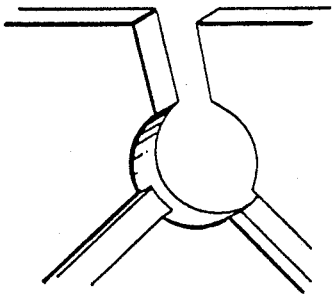
FIGS. 3–6 are partial perspective views of alternate slot configurations useful in the applicator of the present invention.
Figure 4:
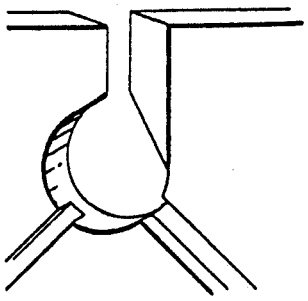

In use, the yarn guiding blocks 5a, 5b and delivery plate 10 are assembled such that the yarn guiding blocks 5a, 5b sandwich delivery plate 10 and the yarn slots 6a, 6b are in alignment with slots 11 as shown in FIG. 2 to provide a yarn passageway. The yarn guide blocks 5a, 5b and the delivery plate 10 are assembled in a tight fitting relationship such that the raised areas or islands 13 of delivery plate 10 seal against yarn guiding block 5a. Any suitable means may be employed to align the components in precise registry with each other and to maintain the components of the applicator in a tight fitting relationship. For example, apertures may be formed in each component which, in the assembled applicator, provide throughways accommodating terminally threaded aligning bolts or rods which receive locking nuts to hold the components of the applicator together.

In operation, the yarn to be treated is continuously passed through the applicator at the base of the yarn slots 6a, 6b of the yarn guide blocks 5a, 5b. The treatment fluid is supplied to inlet 12 and travels through channels 14 and collects in reservoirs. A reservoir for the treatment fluid is formed by each reservoir hole 15 in the delivery plate 10 which is bound almost in its entirety by the surfaces of yarn guide blocks 5a, 5b. The yarn being treated passes through the reservoir since the base of the yarn slots 6a, 6b extend over hole 15 (see FIG. 2). Thus, as yarn positioned at the base of yarn slots 6a, 6b is continuously pulled through the applicator, the yarn is exposed on all sides to the treatment fluid which has accumulated in the reservoir. As the yarn continuously passes through the reservoir, an amount of the treatment fluid which is applied to the yarn is continuously removed from the reservoir. Thus, by continuously supplying treatment fluid to inlet 12 at a rate equal to the rate of consumption, a continuous supply of treatment fluid will be maintained in the reservoir.

In some instances, such as, for example, where the delivery plate is positioned horizontally, the applicator of the invention may include only one yarn guide block, in which case the reservoir will be open on one side and bound by the yarn guide block on the other side.

Figure 5:
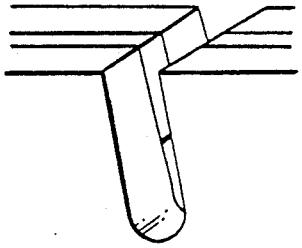
Figure 6:
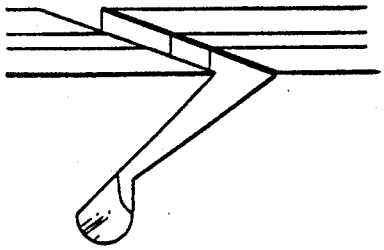

The yarn slots in the guide blocks may advantageously be formed at an angle to an edge of the guide blocks as shown in FIGS. 5–6. This angled slot will help to prevent the yarn from jumping out of the slot during treatment. The yarn slots may also be formed such that when the applicator is assembled, the yarn slots are slightly offset to form a passageway which is slanted with respect to the cross-sectional plane of the delivery plate. A slanted orientation of the passageway will likewise prevent the yarn from jumping out of the slot during treatment.

Another embodiment ensures that the yarn remains in proper position during treatment by including openings formed away from the edge of the guide blocks rather than slots at the edge of the guide blocks. The openings may be of any shape, with round openings being preferred. The openings in the guide blocks overlap the reservoir hole in the delivery plate, thereby forming a yarn passageway through which the yarn can be threaded and positioning the yarn for exposure to the treatment fluid. When the guide blocks include openings rather than slots, the slots need not be provided in the delivery plate.

If the fluid is a liquid, a metering pump may be used to regulate the flow of treatment fluid into the applicator. Alternatively, the liquid can be fed simply by means of the hydraulic pressure in the feed line, requiring only that the supply tank holding the liquid treatment fluid be located at a suitable height with respect to the applicator. The flow rate might typically range between 0.1 to 5.0 cc/min depending upon process speed, yarn denier and the amount of treatment fluid to be applied. If the treatment fluid is a gas, the rate of flow of the gaseous fluid into the applicator should match consumption (including any dispersion of the fluid which may occur).

Figure 7:
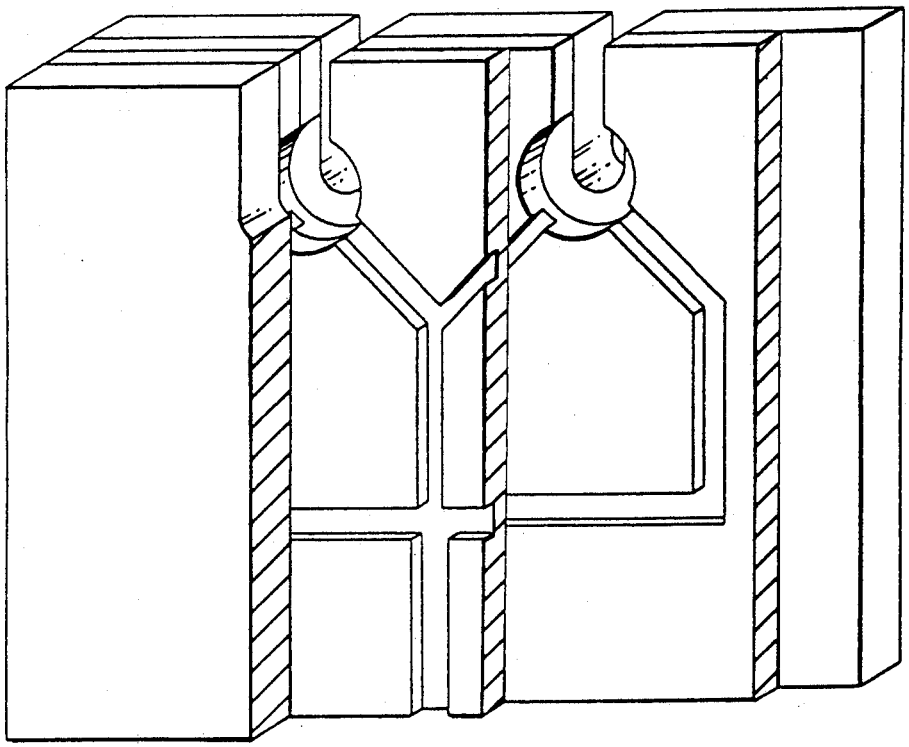
FIG. 7 is a partial perspective view of an alternate embodiment of the invention of FIG. 1 wherein a plurality of plates are used.

It should be understood that by providing a stack of delivery plates as shown in FIGS. 7, perhaps alternating with yarn guide blocks, that repetitive treatments with the same treatment fluid or a series of sequential treatments with different treatment fluids can be achieved.

The foregoing description is to be considered illustrative rather than restrictive of the invention, and those modifications which come within the meaning and range of equivalence of the claims are to be included therein.

What is claimed is:

1. A device for subjecting yarn to treatment by fluid, the device comprising:

at least one guide having an opening formed therein;

sealingly adjoining said at least one guide block, a plate having an opening formed therein, said opening in said plate communicating with said opening in said guide block to provide a yarn passageway;

a supply means for providing treatment fluid to said plate; and a channel formed in said plate communicating said opening in said plate with said supply means, said channel bound along its entire length on one or more sides by said at least one guide plate.

2. A device as in claim 1 wherein said opening in said guide block is formed as a slot at the edge of said guide block.

3. A device for subjecting yarn to treatment fluid, the device comprising:

a pair of guide blocks each having at least one slot formed therein;

a plate intermediate said guide blocks, said plate having at least one slot formed therein;

said at least one slot in said guide blocks and plate being in alignment to provide at least one yarn passageway;

supply means for providing treatment fluid to said plate;

for each slot formed in said plate, an opening communicating with slots in said guide blocks; and a channel formed in said plate communicating said opening with said supply means.

4. A device as in claim 3 wherein said slots are formed at an edge of said guide blocks and said plate.

5. A device as in claim 4 wherein said slots are formed perpendicular to an edge of said guide blocks.

6. A device as in claim 4 wherein said slots are formed at an angle to an edge of said guide blocks.

7. A device as in claim 3 wherein said guide blocks are made of a material which will not cause fraying of the filament.

8. A device as in claim 7 wherein said guide blocks are ceramic.

9. A device as in claim 3 wherein said plate is planar and said slots in said guide blocks and said plate are aligned such that said passageway is slanted with respect to the cross-sectional plane of said plate.

10. A deice for subjecting yarn to treatment by fluid, the device comprising:

at least one guide block having at least one opening formed therein;

sealingly adjoining said at least one guide block a plurality of plates, each said plate having at least one opening formed therein, said openings in said plates communicating with said openings in said guide block to provide at least one yarn passageway; and at least one supply means for providing at least one treatment fluid to at least one of said plates.

11. A device as in claim 10 further comprising at least one channel formed in each said plate communicating said at least one opening in said plate with supply means.

12. A device as in claim 10 wherein said plurality of plates are positioned intermediate a pair of said guide blocks.

* * * * *

UNITED STATES PATENT AND TRADEMARK OFFICE

CERTIFICATE OF CORRECTION

PATENT NO. : 5,181,401

DATED : January 26, 1993

INVENTOR(S) : John A. Hodan

It is certified that error appears in the above-identified patent and that said Letters Patent is hereby corrected as shown below:

Column 1, line 68, delete "devilry" and insert --delivery-- in its place.

Column 2, line 10, delete "stilts" and insert --slots-- in its place.

Column 4, line 41, delete "5-6" after "FIGS." and insert -- 3-6 -- in its place.

Column 5, line 19, insert --block-- after "guide" and before "having".

Column 5, line 33, insert --by-- after "treatment" and before "fluid".

Column 6, line 22, delete "deice" and insert --device-- in its place.

UNITED STATES PATENT AND TRADEMARK OFFICE

CERTIFICATE OF CORRECTION

PATENT NO. : 5,181,401

DATED : January 26, 1993

INVENTOR(S) : John A. Hodan

It is certified that error appears in the above-indentified patent and that said Letters Patent is hereby corrected as shown below:

Column 6, line 29, delete "openings" and insert --opening-- in its place.

Signed and Sealed this

Twenty-sixth Day of October, 1993

*Attest:*

Bruce Lehman

BRUCE LEHMAN

*Attesting Officer*

*Commissioner of Patents and Trademarks*